US005727401A

United States Patent [19]

Statham

[11] Patent Number: 5,727,401

[45] Date of Patent: Mar. 17, 1998

[54] FIRE RESISTANT FLEECE FABRIC AND GARMENT

[75] Inventor: Denise N. Statham, Sharpsburg, Ga.

[73] Assignee: Southern Mills, Inc., Union City, Ga.

[21] Appl. No.: 695,017

[22] Filed: Aug. 9, 1996

Related U.S. Application Data

[60] Provisional application No. 60/002964, Aug. 9, 1995.

[51] Int. Cl. [6] ..... A41B 9/06; D04B 7/12

[52] U.S. Cl. ..... 66/176; 66/191; 66/194; 2/458

[58] Field of Search ..... 66/169 R, 170, 66/171, 190, 191, 192, 194, 195, 196, 202; 28/159, 158, 162; 2/458, 16, 167, 904; 442/313, 314

[56] References Cited

U.S. PATENT DOCUMENTS

| | | | |
|---|---|---|---|
| 1,067,952 | 7/1913 | Volz | 66/194 |
| 2,696,723 | 12/1954 | Frith | 66/194 |
| 3,806,959 | 4/1974 | Gross | 66/202 |
| 4,179,752 | 12/1979 | Fackelmann | 2/2 |
| 4,494,247 | 1/1985 | Kelly | 2/24 |
| 4,513,042 | 4/1985 | Lumb | 66/191 |
| 4,843,646 | 7/1989 | Grilliot et al. | 2/69 |
| 4,945,571 | 8/1990 | Calvert | 2/2 |
| 5,014,354 | 5/1991 | Dumont | 2/23 |
| 5,136,723 | 8/1992 | Aldridge et al. | 2/81 |
| 5,202,086 | 4/1993 | Baliga et al. | 428/225 |
| 5,236,769 | 8/1993 | Paire | 2/458 |
| 5,246,782 | 9/1993 | Kennedy et al. | 428/421 |
| 5,299,602 | 4/1994 | Barbeau et al. | 139/420 |
| 5,323,815 | 6/1994 | Barbeau et al. | 139/420 |
| 5,399,418 | 3/1995 | Hartmanns et al. | 2/904 |
| 5,539,928 | 7/1996 | Aldridge | 2/93 |

*Primary Examiner*—C. D. Crowder
*Assistant Examiner*—Larry D. Worrell, Jr.
*Attorney, Agent, or Firm*—Thomas, Kayden, Horstemeyer & Risley

[57] ABSTRACT

A fire resistant fabric (10) suitable for use as an inner thermal barrier layer in a layered firefighters' turnout garment (30). The fabric is a 3-end knit fleece having stitch yarns (12), tie yarns (14), and nap yarns (18), all made of fire resistant fibers. The nap yarns are pulled away from the stitch and tie yarns to form a fleece.

21 Claims, 1 Drawing Sheet

FIRE RESISTANT FLEECE FABRIC AND GARMENT

RELATED APPLICATIONS

This application claims the benefit of Provisional patent application Ser. No. 60/002,064 filed Aug. 9, 1995.

FIELD OF THE INVENTION

The invention relates generally to firefighters' turnout gear. More particularly, the invention relates to a thermal barrier included in firefighters' turnout gear and a method of making such.

BACKGROUND OF THE INVENTION

For firefighters working on the fireground, the most obvious concern for personal safety is protection against burn injury. Firefighters' turnout gear, which typically consists of matching coat and pants, is designed primarily to prevent the wearer from sustaining a serious burn. The National Fire Protection Association (NFPA) publishes a minimum performance standard for firefighters' turnout gear. This standard is recognized industry-wide as the overall guideline for identifying the minimum level of performance for turnout gear and the fabrics from which they are constructed. For any gear to be labelled compliant with NFPA 1971, the fabrics in that gear must be subjected to many stringent tests, most related to flammability.

A second significant threat to firefighters is heat stress. More firefighter deaths occur in the United States each year due to heat stress related conditions than due to burns. Heat stress related conditions range from elevated body core temperature leading to heat prostration, increased blood pressure, heatstroke, and sometimes heart attack. As this second threat has become recognized, the fire service community has attempted to modify and improve turnout gear to minimize its contribution to heat stress. Although the current NFPA 1971 standard for turnout gear does not mandate any testing to identify a garment's or fabric's propensity for contributing to heat stress, the subject is addressed in the document's appendix to help educate the firefighter on how to select gear which may minimize heat stress. So exciting is this topic that demonstrating that a product could reduce heat stress for a firefighter has become a common and effective marketing tool.

NFPA compliant turnout gear is comprised of three (3) layers: an outer shell, a moisture barrier, and a thermal barrier. The outer shell is usually a woven fabric made from flame resistant fibers. The outer shell is considered a firefighter's first line of defense. Not only should it resist flame, but it needs to be tough and durable so as not to be torn, abraded, or snagged during normal firefighting activities.

The moisture barrier, while also flame resistant, is present to keep water from coming in and saturating the turnout gear. Excess moisture entering the gear from the outside would laden the firefighter with extra weight and increase his or her load. Such an increase in load is likely to increase the possibility of heat stress.

The thermal barrier is flame resistant and offers the bulk of the thermal protection afforded by the ensemble. A traditional thermal barrier is a needlepunched batt of flame resistant fibers quilted to a lightweight woven face cloth also made of flame resistant fibers. The end product is a relatively thick, inflexible fabric that will not stretch due to the limitations placed on it by the face cloth. The quilted product is the innermost layer of the turnout gear and the face cloth may be next to the skin if the firefighter is not wearing a station uniform or is wearing one with short sleeves.

The three-layer ensemble is tested to measure its insulative capability and must meet minimum requirements set forth by NFPA 1971. More than minimal insulation gives greater protection but often by increasing the weight and thickness of the ensemble. Greater protection from burn injury is desired by some firefighters; however, the additional thickness and weight of the garment can lead to increased heat stress. For one thing, thicker, heavier garments generally are less flexible than thinner, lighter ones and greater effort is needed to move and work in garments that are bulky and stiff. Furthermore, the woven face cloth on the traditional thermal barrier creates friction with the station uniform underneath it, making it even more difficult for the firefighter to move inside the turnout gear. This increased exertion can lead to heat stress more quickly and severely.

Thus, there is a need in firefighters' turnout gear for a thinner, more flexible thermal barrier which provides adequate protection against burn injury while reducing stress for the firefighter. There is a need for a thermal barrier that will maintain insulative capability while providing improved comfort characteristics such as increased flexibility, stretch, softness, and smoothness.

SUMMARY OF THE INVENTION

Briefly described, in one aspect, the present invention is a 3-end knit thermal barrier fabric made of flame resistant yarns which offers the wearer the combined advantages of thermal protection and stress-reducing comfort. In another aspect, the invention also includes a heat and flame protective garment for firefighters formed in layers including an outer shell, an intermediate moisture barrier and an inner thermal barrier, with the thermal barrier comprising the light weight 3-end knit fabric. The term "3-end" means that yarns serve one of 3 different functions in the fabric. The yarns employed may all be the same, but the 3-end structure allows the selection of the best yarn for each of the three functions: stitch, tie, and nap.

3-end fabric is a distinctly 2-sided fabric having a noticeable face side and back side. The 3-end fabric includes a knit formed of a stitch yarn and a tie yarn, wherein the stitch yarn lies on the fabric face side. A nap yarn lies on the back side of the fabric and is tied into the knit at periodic intervals. The fabric is subjected to a napping or fraying operation which pulls the nap yarn away from the knit, forming a fleece on the back side of the fabric.

A firefighter's turnout gear is disclosed incorporating the thermal barrier of the invention. The turnout gear includes a coat and pants, each having a 3 layer structure. An outer shell and moisture barrier are provided such as are presently used for turnout gear. An inside layer of a thermal barrier is provided made of the presently disclosed fabric with the face side of the fabric towards the firefighter. The turnout gear is assembled and sewn as is presently known in the art.

To manufacture the presently disclosed 3-end fabric, a knit is formed of the stitch yarn, the tie yarn, and the nap yarn. The nap yarn is tied into the knit at designed periodic intervals. Following the knitting process, the greige goods are subjected to a napping or fraying operation where available fibers are brushed with wires. The brushing action raises the fibers to an essentially upright position thereby increasing the thickness of the fabric and thus enhancing its thermal characteristics.

After napping, the fabric is heatset in an oven to stabilize its dimensions. A wickable, repellant, or other finish can be applied during the heatsetting operation if desired.

In a preferred embodiment, the stretch yarn is a filament yarn so that the face side is smooth. All three yarns are made of a flame resistant material.

The resultant fabric is flame resistant and compliant with NFPA 1971 for firefighters' turnout gear. More importantly, it exhibits favorable comfort characteristics, including stretchability and flexibility, which serve to reduce stress to those wearing gear made from it. Other features and advantages of the present invention will become apparent upon reading the following specification, when taken in conjunction with the accompanying drawings.

DETAILED DESCRIPTION

Figure 1:
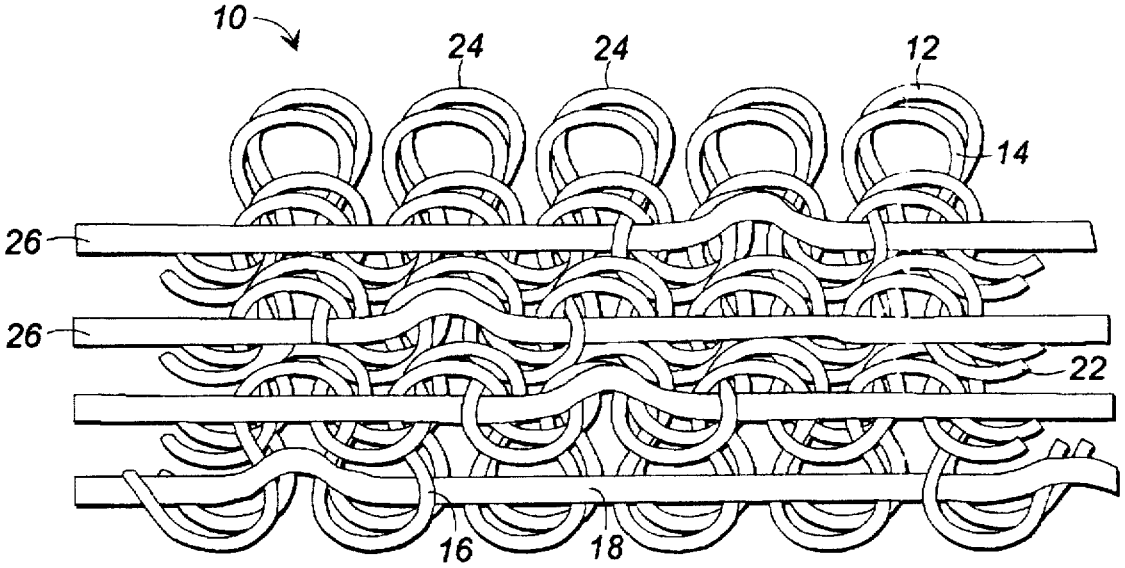
FIG. 1 is a plan schematic view of the 3-end knit before it is napped.

The 3-end knit structure comprises the interaction of three yarns each serving their own function. The technical back of the knit is covered by the nap yarn which appears to be laid in loops across the surface of the knit and is only periodically tied into the structure. The looseness of these nap yarns contributes to the quality of the napping operation which takes place following knitting. The fibers in the nap yarn must be available to wire brushes but also must be adequately connected to the fabric. The nap yarn should be flame resistant and can be made out of a flame resistant material such as aramids, flame resistant polynosic rayon, flame resistant cotton, flame resistant polyester, polybenzimidazole, polyvinyl alcohol, polytetrafluoroethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof. Preferably the material is an aramid or flame resistant polynesic rayon. Most preferably, the material is NOMEX® 462, a brand name for a mix of 93% poly(m-phenyleneisophthalamide), 5% poly (p-phenyleneterephthalamide), and 2% antistatic fiber comprising a nylon wrapped carbon fiber. The nap yarn can be a filament yarn or a spun yarn. The nap yarn can be single ply or multi-ply but is preferably a single ply as the use of single ply yarn increases the flexibility of the final fabric.

The nap yarn, also known as a fleecy or backing yarn, is attached to the knit by the tie or tie-in yarn which is not visible from the face side of the fabric. The overall strength of the knit is greatly determined by the strength of the tie yarn. The tie yarn is made from a flame resistant material such as aramids, flame resistant polynosic rayon, flame resistant cotton, flame resistant polyester, polybenzimidazole, polyvinyl alcohol, polytetrafluoroethylene, flame resistant wool, poly(vinyl chloride), polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof. The tie yarn can be a filament yarn or spun yarn and is preferably a single ply yarn.

The stitch or face yarn determines the texture of the face of the fleece. It is the only yarn of the three that is visible from the face side of the cloth. The stitch yarn is a flame resistant yarn such as one made from aramids, flame resistant polynosic rayon, flame resistant cotton, flame resistant polyester, polybenzimidazole, polyvinyl alcohol, polytetrafluoroethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof. The stitch yarn can be a filament yarn or spun yarn but is preferably a filament yarn since filament yarns are smoother and the use of filament yarn enhances the smoothness of the face side and reduces friction during donning, doffing, and all activity undertaken while the garment is being worn. The stitch yarn is preferably single ply.

A careful analysis of what fibers and yarn sizes to employ leads to a fabric that is well-suited to the desired characteristics of a face cloth of the thermal barrier. Firefighters working in different conditions may prefer to have turnout gear with different characteristics. Choosing lighter yarns will yield a relatively lightweight fabric. However, weight affects the insulative capabilities of a fabric so there are limitations to how light a quality thermal barrier of this type can be. The yarn counts can be optimized to produce a fabric with acceptable thermal characteristics without any excess weight. The stitch yarn is preferably a filament yarn having a weight ranging from about 100 denier to about 500 denier, preferably about 200 denier. The tie yarn can be spun yarn or filament. If filament, the tie yarn also should have a weight of between about 100 to 500 denier and, preferably, about 200 denier. The nap yarn is preferably a single ply spun yarn having a size from about 30 to 37 cotton count. The nap yarn could be a two ply yarn having a cotton count of 60. Coarser nap yarns would provide a heavier fleece for more insulative protection, but would also provide a heavier garment. However, these features may be preferred for some applications.

FIG. 1 illustrates the back side of a preferred embodiment of the 3-end knit structure in detail before it is napped. Generally, the knit fabric consists of stitch yarns 12 which are illustrated as the dark loops of FIG. 1 and tie yarns 14 which are illustrated as the light colored yarns of FIG. 1 and which overlie and follow approximately the same paths as the stitch yarns 12 to form a knitted face layer. Nap yarns 18, which are dark colored, extend approximately straight across the back of the stitch yarns 12 and tie yarns 14 except at periodic locations 16 where the nap yarns 18 are tied into the tie yarns 14 of the fabric's technical back at about every fourth wale or column 24 of the tie yarns. The knit pattern shown in FIG. 1 is called a 3-end fleece pattern. Other patterns can be used, such as a 2-end fleece or a terry-cloth, for example.

FIG. 1 illustrates in schematic the fabric from back side 22 which normally faces away from the wearer of the garment made of this fabric. Although only the stitch yarn 12 is visible on the face side of the fabric, the tie yarn 14 follows an overlying parallel path as the stitch yarn 12 except where the nap yarn 18 is tied in. At points 16 where the nap yarn 18 is due to be tied-in, the nap yarn 18 is laid under the tie yarn 14 which holds the nap yarn 18 to the back side 22 of the fabric.

In subsequent courses or rows 26, the nap yarn 18 is tied in on different wales 24 to more evenly distribute the nap yarns 18 and to avoid the creation of thin places where little yarn is available for napping. The nap yarn 18 can be tied in more or less frequently than once every four wales.

To form a fabric from the three yarns, the stitch yarns 12, tie yarns 14, and nap yarns 18 are formed into a 3-end knit structure. The nap yarn is laid down on the stitch and tie structure and tied into the structure at designed periodic locations. The knit is then subjected to a napping or fraying operation which pulls the nap yarns away from the back of the knit fabric so that a fleece or napped back layer is formed. The napping operation is performed in the conventional way, brushing the fabric with wires. The napping operation increases the bulk or thickness of the fabric without increasing the fabric weight. The fleeced or napped fibers create a more insulative layer than the flat fabric. Thus, the fabric functions as a better thermal barrier without increasing the weight load on a firefighter wearing a garment incorporating the fabric. In one embodiment, the thickness of the fabric before napping was about 0.074 inches; after napping, the thickness was 0.110 inches, an increase of about 49%.

After napping, the fabric may be heatset in an oven.

Figure 2:
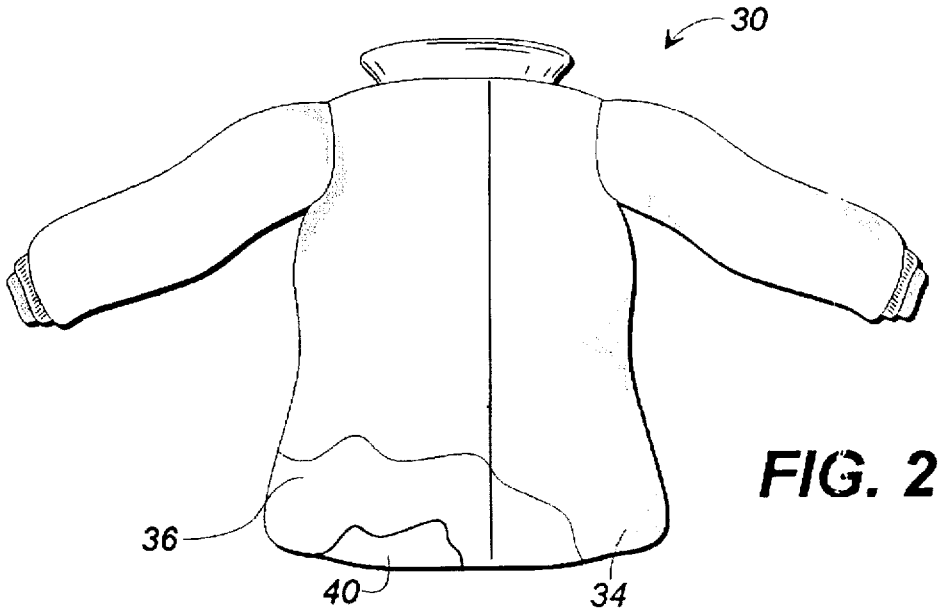
FIG. 2 is a perspective, partial cut-away view of a firefighter's turnout garment including a thermal barrier made of a fabric of the knit of FIG. 1.

FIG. 2 illustrates a firefighter's turnout garment which includes the 3-end fabric of FIG. 1. The turnout garment includes a coat 30 and pants (not shown). The coat has an outer shell 34 which is made from a conventional woven fabric formed of flame resistant fibers such as NOMEX®, and is tough and durable. The intermediate layer of material of the garment is the conventional moisture barrier 36 which includes a woven fabric laminated to a membrane made of neoprene or GORE-TEX® brand polytetrafluoro ethylene coated fabric. The inner layer 40 comprises a thermal barrier made of the 3-end knit fabric described above. The back side 22 of the fabric, as shown in FIG. 2 faces the membrane side of the moisture barrier. The face side of the 3-end knit fabric faces towards the firefighter's skin or uniform. The three layers can be assembled into a coat in the standard way. The combination of layers of materials forms a light weight flexible garment highly suitable for use by firefighters in extreme heat conditions.

The assembly of the garment in the order above described presents several advantages. The face side of the 3-end knit fabric is smooth and so the firefighter has less resistance to donning and doffing the garment, and movement while wearing the garment. Thus, heat stress is possibly partially alleviated. Also, because the fleece side of the 3-end knit fabric is towards the inside, that is, towards the smooth membrane side of the moisture barrier, wear on the fabric is minimized because the fleece is not exposed during wear and laundering, for example.

While the invention has been described in a particular, preferred embodiment it should be apparent to those of skill in the art that variations and modifications thereof can be made without departing from the spirit and scope of the invention as set forth in the following claims.

What is claimed:

1. A fabric suitable for use as a thermal barrier in a firefighter's turnout garment, said fabric having a face side for facing the firefighter and a back side for facing the garment, said fabric comprising:

a 3-end knit formed of stitch yarns, tie yarns, and nap yarns, said stitch yarns and said tie yarns following substantially identical parallel paths along said knit, wherein said stitch yarns form the face side of the fabric and said nap yarns are tied into the knit at periodic locations along the back side of the fabric by the tie yarns;

wherein portions of the nap yarns are pulled away from the 3-end knit to form a fleece on the back side of the fabric; and wherein said stitch yarns, tie yarns, and nap yarns are made of a fibrous flame resistant material.

2. The fabric of claim 1, wherein said stitch yarns are filament yarns.

3. The fabric of claim 1, wherein said stitch yarns, said tie yarns, and said nap yarns are formed from a flame resistant material selected from the group consisting of aramids, flame resistant polynosic rayon, flame resistant cotton, flame resistant polyester, polybenzimidazole, polyvinyl alcohol, polytetrafluoroethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof.

4. The fabric of claim 1, wherein said flame resistant material is aramid or flame resistant polynosic rayon.

5. The fabric of claim 1, wherein said stitch yarns, said tie yarns, and said nap yarns are substantially entirely made of aramid fibers.

6. A process of making a fabric suitable for use as a face cloth of a thermal barrier in a firefighter's turnout gear, comprising the steps of:

forming a 3-end knit of stitch yarns, tie yarns, and nap yarns, wherein the stitch yarns and the tie yarns follow substantially identical parallel paths along the knit and wherein the nap yarns are loosely tied into the knit at periodic intervals; and subjecting the knit to a napping operation so that the nap yarns are pulled away from the knit to form a fleece;

wherein the stitch yarns, tie yarns, and nap yarns are made of a flame resistant material.

7. The process of claim 6, further comprising the step of heat setting the fabric.

8. The process of claim 7, further comprising the step of applying a finish to the fabric.

9. The process of claim 6, further comprising the step of selecting the flame resistant material from the group consisting of aramids, flame resistant polynosic rayon, flame resistant cotton, flame resistant polyester, polybenzimidazole, polyvinyl alcohol, polytetrafluoroethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof.

10. The process of claim 6, wherein said stitch yarns are filament yarns and wherein only stitch yarns form the face side of the fabric.

11. The process of claim 6, wherein said flame resistant material is aramid or flame resistant polynosic rayon.

12. The process of claim 6, wherein said stitch yarn, said tie yarn, and said nap yarn are substantially entirely made of aramid fibers.

13. A layered firefighter's turnout garment, comprising:

an outer layer comprising a shell made of flame resistant fibers;

an intermediate layer formed of a moisture barrier material; and an inner layer of a thermal barrier material made of a 3-end knit fabric of flame resistant fibers including stitch yarns, tie yarns, and nap yarns, wherein the stitch yarns and the tie yarns follow substantially identical parallel paths along said fabric, the stitch yarns form a face side of the fabric, and the nap yarns are periodically tied into a back side of the fabric with the tie yarns, and wherein portions of the nap yarns are pulled away from the tie and stitch yarns to form a fleece on the back side of the thermal barrier material.

14. The firefighter's turnout garment of claim 13, wherein said stitch yarns of said inner layer are filament yarns and wherein and said of the fabric face side faces the firefighter.

15. The firefighter's turnout gear of claim 13, wherein said stitch yarns, said tie yarns, and said nap yarns are formed from a flame resistant material selected from the group consisting of aramids, flame resistant polynosic rayon, flame resistant cotton, flame resistant polyester, polybenzimidazole, polyvinyl alcohol, polytetrafluoroethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof.

16. The firefighter's turnout garment of claim 13, wherein said flame resistant material is aramid or flame resistant polynosic rayon.

17. A fleece knit thermal barrier fabric suitable for use as an interior layer of a firefighter's garment having an outer layer of a tough and durable flame resistant material and an intermediate moisture barrier layer, said fleece knit thermal barrier fabric comprising:

a knitted face layer including a plurality of flame resistant tie yarns; and a napped back layer integrally formed with said knitted face layer, said napped back layer including a plurality of flame resistant nap yarns that are tied into said knitted face layer by said tie yarns and which have portions thereof pulled away to form a nap surface for facing the intermediate moisture barrier layer of the garment.

18. The fleece knit thermal barrier fabric of claim 17, wherein said knitted face layer further includes a plurality of flame resistant face yarns which follow substantially identical parallel paths along said knitted face layer as said flame resistant tie yarns, said face yarns forming a face surface on said knitted face layer which is adapted to face the garment wearer.

19. The fleece kit thermal barrier fabric of claim 18 wherein said flame resistant face yarns are filament yarns.

20. The fleece knit thermal barrier fabric of claim 18 wherein said face yarns, said tie yarns, and said nap yarns are formed from a time resistant material selected from the group consisting of aramids, flame resistant polynosic rayon, flame resistant cotton, flame resistant polyester, polybenzimidazole, polyvinyl alcohol, polytetrafluorethylene, flame resistant wool, polyvinyl chloride, polyetheretherketone, polyetherimide, polyethersulfone, polychlal, polyimide, polyamide, polyimide-amide, polyolefin, polybenzoxazole, flame resistant acetone, carbon, modacrylic, acrylic, melamine, glass, and copolymers and mixtures thereof.

21. The fleece knit thermal barrier fabric of claim 20, wherein said flame resistant material is aramid or flame resistant polynosic rayon.

* * * * *